US010041733B2

(12) United States Patent
Banik et al.

(10) Patent No.: US 10,041,733 B2
(45) Date of Patent: Aug. 7, 2018

(54) APPARATUS FOR THE HEAT TREATMENT OF COATED SEMI-FINISHED STEEL PRODUCTS

(71) Applicant: THYSSENKRUPP STEEL EUROPE AG, Duisburg (DE)

(72) Inventors: Janko Banik, Altena (DE); Maria Köyer, Dortmund (DE); Georg Parma, Dortmund (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 21 days.

(21) Appl. No.: 14/906,516

(22) PCT Filed: Jul. 16, 2014

(86) PCT No.: PCT/EP2014/065304

§ 371 (c)(1),
(2) Date: Jan. 20, 2016

(87) PCT Pub. No.: WO2015/011002

PCT Pub. Date: Jan. 29, 2015

(65) Prior Publication Data

US 2016/0195332 A1 Jul. 7, 2016

(30) Foreign Application Priority Data

Jul. 22, 2013 (DE) ..... 10 2013 107 777

(51) Int. Cl.
*B05C 13/02* (2006.01)
*F27B 9/24* (2006.01)
(Continued)

(52) U.S. Cl.
CPC ..... *F27B 9/2407* (2013.01); *C21D 9/0018* (2013.01); *C23C 28/00* (2013.01);
(Continued)

(58) Field of Classification Search
USPC ..... 118/58–60, 66; 266/249–252
See application file for complete search history.

(56) References Cited

U.S. PATENT DOCUMENTS 5,885,522 A * 3/1999 Giannini ..... B21D 3/05 148/646
7,704,447 B2 * 4/2010 Danger ..... C21D 9/46 266/249
(Continued)

FOREIGN PATENT DOCUMENTS

CN 102985570 A 3/2013
DE 10 2011 051 270 A1 12/2012
(Continued)

OTHER PUBLICATIONS

German Language International Search Report for International patent application No. PCT/EP2014/065304; dated Oct. 23, 2014.
(Continued)

*Primary Examiner* — Yewebdar T Tadesse
(74) *Attorney, Agent, or Firm* — thyssenkrupp North America, Inc.

(57) ABSTRACT

An apparatus for heat treatment of coated semi-finished steel products may comprise a heatable continuous furnace having a conveyer for moving the coated semi-finished steel products. The conveyer may be comprised of a plurality of conveyer elements, such as rollers, for example, for supporting the coated semi-finished steel products. To prevent, or at least substantially prevent, interaction between semi-finished steel products having different coatings, a decoupling portion of the continuous furnace may include a first conveyer element group and a second conveyer element group, each having at least one conveyer element. The coated semi-finished steel products may be supported in the decoupling portion either by the conveyer elements of the first conveyer element group or by the conveyer elements of the second conveyer element group.

20 Claims, 3 Drawing Sheets

(51) Int. Cl.

| | |
|---|---|
| ***F27B 9/02*** | (2006.01) |
| ***C21D 9/00*** | (2006.01) |
| ***C23C 28/00*** | (2006.01) |
| ***C23C 30/00*** | (2006.01) |
| *F27B 9/30* | (2006.01) |

(52) U.S. Cl.
CPC ..... *C23C 30/005* (2013.01); *F27B 9/02* (2013.01); *F27B 9/028* (2013.01); *F27B 2009/3094* (2013.01)

(56) References Cited

U.S. PATENT DOCUMENTS

| | | | | |
|---|---|---|---|---|
| 2007/0257407 | A1 | 11/2007 | Danger et al. | |
| 2013/0206284 | A1 | 8/2013 | Norden et al. | |
| 2014/0124104 | A1* | 5/2014 | Trippe ..... | B21D 22/022 148/566 |

FOREIGN PATENT DOCUMENTS

| | | | |
|---|---|---|---|
| EP | 1 830 147 | B1 | 4/2012 |
| JP | 2000 051920 | A | 2/2000 |
| WO | 2011009769 | A1 | 1/2011 |

OTHER PUBLICATIONS

English translation of International Search Report for International patent application No. PCT/EP2014/065304; dated Oct. 23, 2014.
English translation of the abstract of JP 2000 051920 A.
English translation of the abstract of DE 10 2011 051 270 A1.
English translation of the abstract of EP 1 830 147 B1.
German language International Preliminary Report on Patentability for International patent application No. PCT/EP2014/065304; dated Aug. 17, 2015.

* cited by examiner

APPARATUS FOR THE HEAT TREATMENT OF COATED SEMI-FINISHED STEEL PRODUCTS

CROSS REFERENCE TO RELATED APPLICATIONS

This application is a U.S. National Stage Entry of International Patent Application Serial Number PCT/EP2014/065304, filed Jul. 16, 2014, which claims priority to German Patent Application No. DE 102013107777.3 filed Jul. 22, 2013, the entire contents of both of which are incorporated herein by reference.

FIELD

The present disclosure relates to apparatuses for the heat treatment of coated semi-finished steel products.

BACKGROUND

The heat treatment of semi-finished steel products is undertaken in particular for austenitizing purposes for press-hardening preparation. By means of austenitizing with subsequent press hardening, i.e. the deformation and quenching of the semi-finished steel product heated to approximately 800-1000° C., the formed semi-finished steel product has a martensitic structure, as a result of which the strength of the formed semi-finished steel product significantly increases.

In order to protect the semi-finished steel products from corrosion and oxidation during transport and during the heat treatment, it is known to provide said semi-finished steel products with an AlSi coating. For example, it is furthermore known from DE 10 2011 051 270 A1 that said coating first of all melts from the solid state during austenitizing and subsequently alloys into the basic steel material of the semi-finished steel products. It is furthermore known from said prior art that the coating material is deposited on the rollers used as the conveyer elements.

It is furthermore known from the described prior art to use mullite as the ceramic material for the rollers. If the Al—Si coating melts during the heat treatment, a liquid to viscous Al—Si layer forms on the mullite rollers in a region dependent on the heating profile. Since, during the heat treatment, the Al—Si alloys up with the iron of the semi-finished steel product, said AlSi layer arises on the ceramic rollers within a characteristic temperature and time range. Which conveyer elements are affected by the described deposits depends, firstly, as already described, on the temperature and time profile and, secondly, on the conveyer element surface material which comes into contact with the surface of the semi-finished steel products.

As an alternative to the coating of the semi-finished steel products with AlSi, zinc alloy platings, for example platings with a zinc and nickel coating, are furthermore known. Such semi-finished steel products with a zinc-based coating also have to be austenitized for press-hardening preparation.

Both the AlSi-coated semi-finished steel products and the semi-finished steel products with a zinc-based coating are suitable for the direct press hardening. In the direct press hardening, a blank is punched out of a coil and supplied for heat treatment without prior deformation. By contrast, in the "indirect method", a blank is punched out of a coil, and subsequently cold-worked, and the preformed component is then supplied for heat treatment likewise for austenitizing purposes. In the direct method, which is preferred because of the one-step nature thereof, intensive contact between the surface of the blank and the conveyer elements of the heat treatment apparatus occurs during the transport of the flat blank. By contrast, in the indirect method, the preformed components are generally transported on work piece carriers during the heat treatment for austenitizing purposes. In this case, there is therefore generally no contact between the coated semi-finished steel product and the conveyer elements.

If then, during the direct method, alternating campaigns with AlSi-coated semi-finished steel products and semi-finished steel products with a zinc-based coating are conducted, interactions of the AlSi deposits on the conveyer elements with the zinc-based coating of the correspondingly coated semi-finished steel products occur. There are formed here, inter alia, low-melting phases, for example zinc and aluminum phases, which may lead to cracking on the component. During such alternating campaigns, it is also possible, on the surface of the austenitized semi-finished steel products, to determine Zn—Al particles, for example, which may both result in a higher degree of wear of the pressing tool and, furthermore, may influence the surface quality and varnish adhesion of the component.

DETAILED DESCRIPTION

Figure 1:
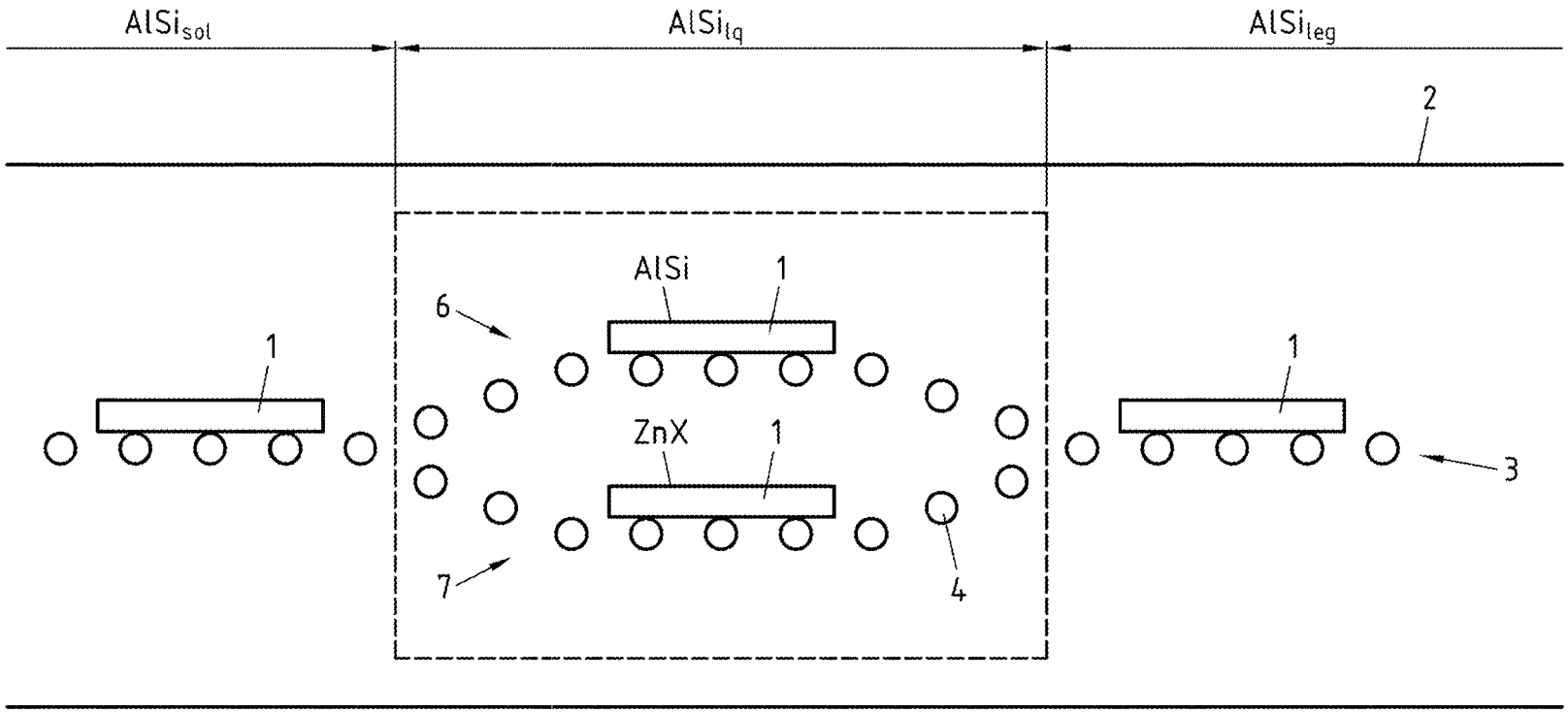
FIG. 1 is a side schematic diagram of an example continuous furnace having an example conveyer device.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The present disclosure relates to apparatuses for the heat treatment of coated semi-finished steel products. One example apparatus may comprise at least one heatable continuous furnace with at least one conveyer device for the semi-finished steel products, wherein the conveyer device has conveyer elements and the semi-finished steel products rest on the conveyer elements in the continuous furnace.

The present invention is therefore based on the object of refining and developing the known apparatuses for the heat treatment of coated semi-finished steel products in such a manner that, during the direct press hardening, alternating campaigns with AlSi-coated semi-finished steel products, semi-finished steel products with a zinc-based coating and/or with further coating systems on an organic or inorganic basis, which is suitable for the heat forming, can be conducted without this leading to adverse effects during the press hardening and without the press-hardened products being impaired.

According to the invention, the previously derived and disclosed object is achieved in that at least one decoupling portion of the continuous furnace has at least two conveyer element groups, each conveyer element group has at least one conveyer element, and, in the decoupling portion, the semi-finished steel product rests either on the conveyer elements of the first conveyer element group or on the conveyer elements of the second conveyer element group.

According to the invention, it has therefore been recognized that the, for example, AlSi-coated semi-finished steel products have to be transported within the temperature and time range, in which the coating melts and forms deposits on the conveyer elements, in a decoupled manner on a first conveyer element group which is replaced by a second conveyer element group during the transport of, for example, semi-finished steel products with a zinc-based coating. Of course, use may also be made of further coating systems on an organic or inorganic basis, which are suitable for the heat forming. By this means, it is ensured that the semi-finished steel products with a zinc-based coating, for example, do not come into contact with the conveyer elements impinged by deposits of the, for example, AlSi melt. This effectively avoids the alternating contamination of the respective coatings with material foreign to the coating. Within the temperature and time range in which the, for example, AlSi alloys have not yet melted, such a decoupling is just as little necessary as within the temperature and time range in which the, for example, AlSi alloy has been alloyed into the material of the semi-finished steel product to an extent such that deposits of the coating on the conveyer elements no longer occurs.

By means of the decoupling, which is ensured according to the invention, of the transport of the differently coated semi-finished steel products within the critical temperature and time range, a substantially free control of the temperature within the continuous furnace is ensured, i.e. both during the heat treatment of the, for example, AlSi-coated components and of the components with a zinc-based coating, for example, the temperature profiles which are optimum for austenitizing can be operated in the apparatus.

As a result of the fact that, according to a first refinement, AlSi-coated semi-finished steel products preferably rest on the conveyer elements of the first conveyer element group and semi-finished steel products with a zinc-based coating preferably rest on the conveyer elements of the second conveyer element group, the alternating contact of adhesions of the other coating in each case is prevented.

As already mentioned with regard to the prior art, the conveyer elements are designed, according to a first alternative, as rollers. Said transport rollers have been substantially tried and tested and are reliable.

According to a second alternative, the conveyer elements are designed as semi-finished-product carriers which are connected to a transport chain. During a guiding of the semi-finished-product carriers through a slot in the furnace wall, this refinement makes it possible to arrange the movable parts, i.e. essentially the transport chain, outside the high temperature region.

Owing to the fact that, within the continuous furnace, the first conveyer element group is arranged in a first furnace chamber of the decoupling portion and the second conveyer element group is arranged in a second furnace chamber of the decoupling portion, it is ensured that, for example during the operation of the first furnace chamber, the second furnace chamber may be subject to maintenance, in particular to cleaning of the conveyer elements.

Decoupling can be ensured particularly easily by the fact that in a furnace chamber of the decoupling portion, the first conveyer element group is designed as a first roller conveyer and the second conveyer element group is designed as a second roller conveyer. By this means, a very compact arrangement of the decoupled conveyer element groups is ensured.

In order to ensure the necessary connection of the decoupling portion to the remaining portions of the continuous furnace, at least one furnace chamber of the continuous furnace is height-adjustable and/or laterally adjustable. By this means, for example, the roller conveyers are in each case aligned with the further portions of the continuous furnace by corresponding adjustment of the furnace chamber.

Alternatively to or cumulatively with the height and lateral adjustability of a furnace chamber of the continuous furnace, a furnace distributing guide is arranged upstream and/or downstream of the decoupling portion. With the aid of said furnace distributing guide, a sometimes complicated partial or complete traverse of the furnace chamber can be reduced or avoided. Within such a furnace distributing guide, the conveyer elements arranged in a furnace chamber are arranged, for example, height-adjustably or laterally adjustably.

Owing to the fact that the conveyer elements of the first and the second conveyer element groups are height-adjustable relative to one another, the decoupling according to the invention can be ensured without a furnace chamber being height-adjustable or without the use of a furnace distributing guide. With said height-adjustability, it is possible, for example, for every second roller in a roller conveyer or for every second semi-finished-product carrier connected to a transport chain to be lowered within the decoupling portion during the change of campaigns. Said rollers then do not come into contact with the semi-finished steel product.

The apparatus according to the invention is preferably refined further by the fact that the continuous furnace has a homogenizing portion following the decoupling portion in the conveying direction. The alloying of the, for example, AlSi coating into the material of the semi-finished steel product leads to at any rate the substantial portion of the homogenization taking place in a region in which there need be no concern about, for example, AlSi deposits on the conveyer elements. The joint use of the homogenizing portion both for campaigns with, for example, AlSi-coated components and components with a zinc-based coating, for example, and/or with further coating systems on an organic or inorganic basis, which are suitable for the heat forming, leads to reduced plant costs.

As prompt a transfer as possible of the austenitized semi-finished steel products is ensured by the fact that an initial region of the continuous furnace is assigned to a forming press. In the transfer of the semi-finished steel products to the forming press, it is crucial for the heated semi-finished steel products to enter the press in a defined state and to subsequently be press-hardened. This is ensured by a direct allocation of the outlet region of the continuous furnace to a forming press.

Discussed above are a multitude of examples for refining and developing the teaching according to the invention for improving an apparatus for the heat treatment of coated semi-finished steel products. Further examples are described in more detail with reference now to the drawings.

The schematic diagram of an apparatus according to the invention for the heat treatment of coated semi-finished steel products 1 has a continuous furnace 2 which is merely indicated in FIG. 1. A conveyer device 3 for the semi-finished steel products 1, which conveyer device has rollers 4 as conveyer elements, is illustrated here. As can be seen, the semi-finished steel products 1 which are to be austenitized as intermediate products for direct press hardening and are in the form of blanks rest on the rollers 4 in the continuous furnace.

According to the invention, a decoupling portion 5 of the continuous furnace 2 has two conveyer element groups 6, 7.

Each of the conveyer element groups 6, 7 here has a plurality of conveyer elements designed as rollers 4, and, in the decoupling portion 5, the semi-finished steel product 1 rests either on the conveyer elements of the first conveyer element group 6 or on the conveyer elements of the second conveyer element group 7.

It is schematically illustrated in FIG. 1 that the decoupling portion 5 is arranged within the temperature and time range in which the, for example, AlSi coating is already liquefied ($AlSi_{lq}$), i.e. is no longer in the originally solid state ($AlSi_{sol}$) and has also not yet been alloyed ($AlSi_{leg}$) into the material of the semi-finished steel product 1 by means of the high temperatures.

Owing to the fact that AlSi-coated semi-finished steel products 1, as illustrated schematically in FIG. 1, rest on the conveyer elements of the first conveyer element group 6 and semi-finished steel products with a zinc-based coating, for example, rest on the conveyer elements of the second conveyer element group 7, an alternating contamination of the coatings by deposits on the conveyer elements, which are designed as rollers 4, within the decoupling zone 5 is prevented.

Figure 2:
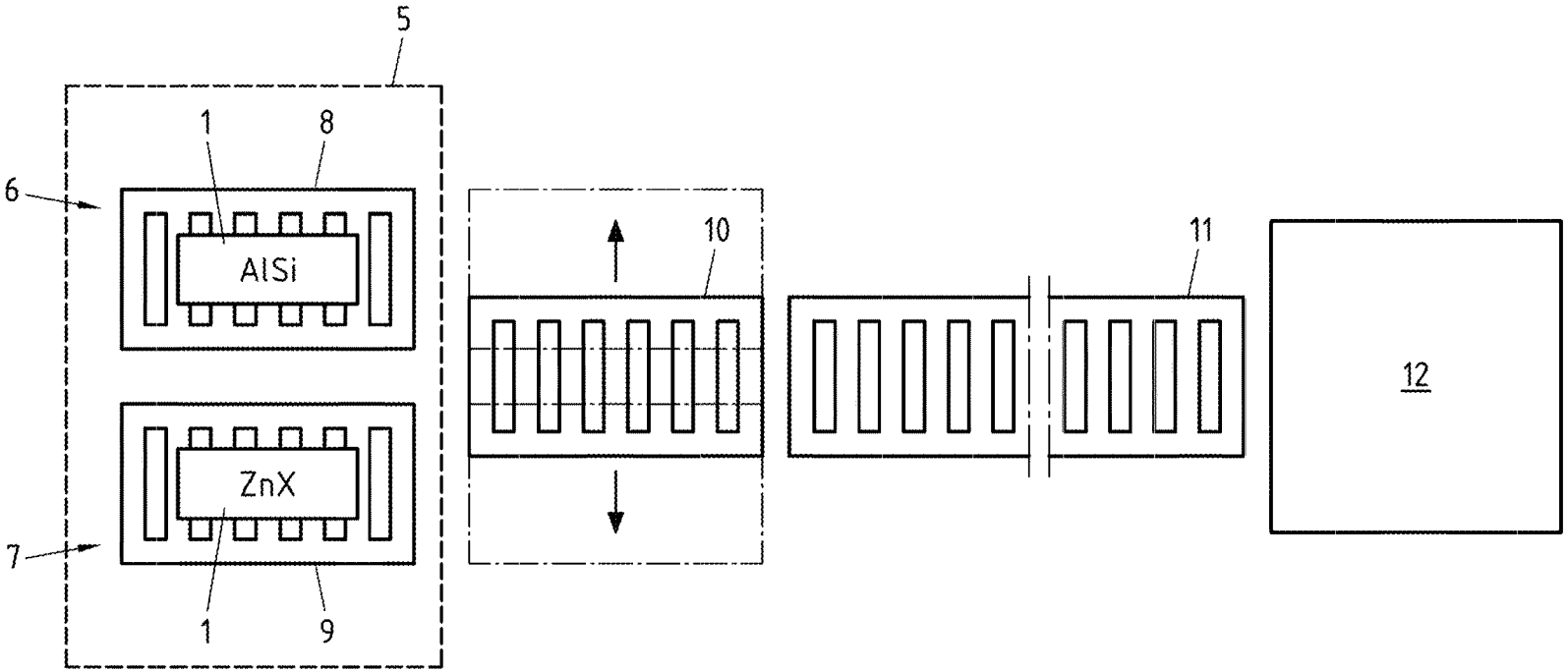
FIG. 2 is a top schematic view of an example apparatus for the heat treatment of coated semi-finished steel products.

In the first exemplary embodiment, illustrated in FIG. 2, of an apparatus according to the invention, the first conveyer element group 6 is arranged in a first furnace chamber 8 of the decoupling portion 5 and the second conveyer element group 7 is arranged in a second furnace chamber 9 of the decoupling portion 5.

Figure 3:
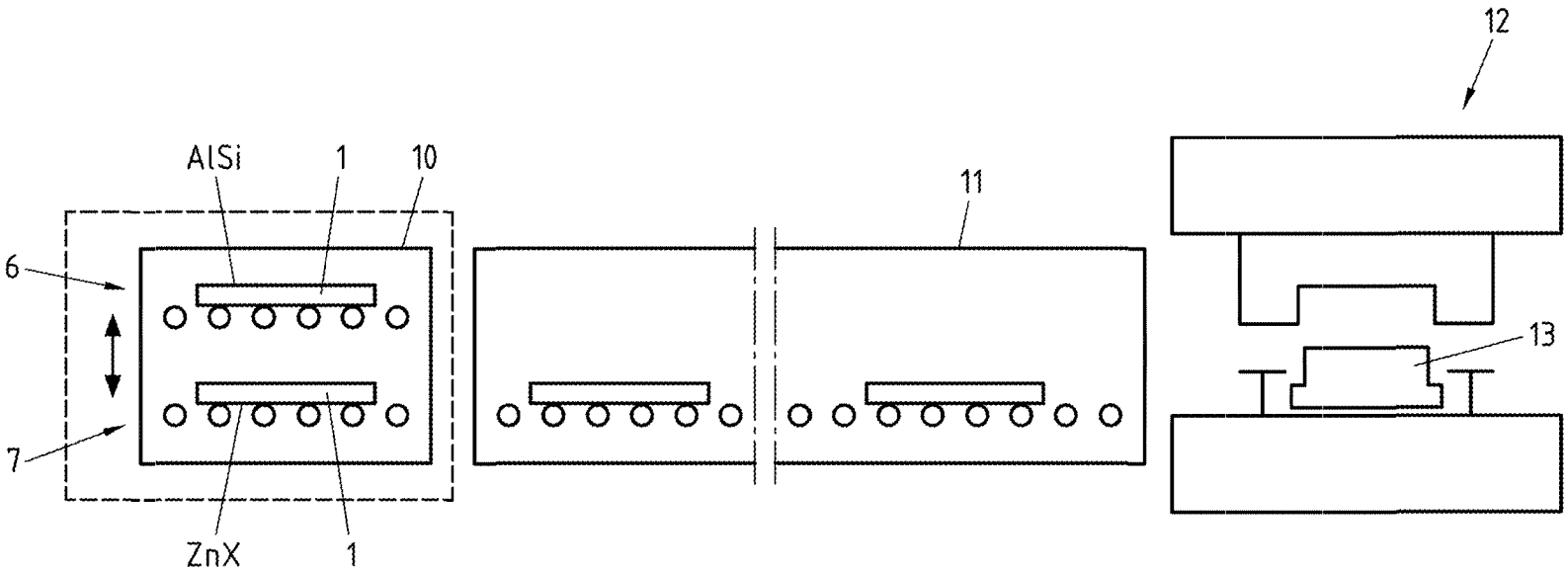
FIG. 3 is a side schematic view of another example apparatus for the heat treatment of coated semi-finished steel products.

By contrast, in the second exemplary embodiment, illustrated in FIG. 3, of an apparatus according to the invention, in a furnace chamber 10 of the decoupling portion 5 the first conveyer element group 6 and the second conveyer element group 7 are in each case designed as roller conveyers located one above the other.

In the first exemplary embodiment which is illustrated in FIG. 2, in order to couple the decoupling portion 5, a furnace chamber 10 is designed to be laterally adjustable and thus forms a "furnace ferry". The semi-finished steel products 1 are transferred from the furnace chamber 10 to a homogenizing portion 11, the outlet region of which is allocated to a forming press 12 (likewise illustrated schematically).

In the second exemplary embodiment, which is illustrated in a side view in FIG. 3, of an apparatus according to the invention, the furnace chamber 10 provided in the decoupling portion 5 is height-adjustable, as a result of which the transfer of the semi-finished steel products 1 is ensured without a separate furnace distributing guide.

In the exemplary embodiment which is illustrated in FIG. 3, the press-hardened work piece 13 is illustrated in the forming press 12.

What is claimed is:

1. An apparatus for heat treatment of coated semi-finished steel products, the apparatus comprising:

at least one heatable continuous furnace comprising, at least one conveyer for moving the coated semi-finished steel products, wherein the at least one conveyer has a plurality of conveyer elements for supporting the coated semi-finished steel products, at least one decoupling portion comprising a first conveyer element group and a second conveyer element group, with each of the first and second conveyer element groups having at least one conveyer element from the plurality of conveyor elements for supporting the coated semi-finished steel products, wherein in the at least one decoupling portion the at least one conveyer element of the first conveyer element group is configured to support a first subset of the coated semi-finished steel products, wherein the coated semi-finished steel products in the first subset have an Al—Si coat, and wherein in the at least one decoupling portion the at least one conveyer element of the second conveyer element group is configured to support a second subset of the coated semi-finished steel products, wherein the coated semi-finished steel products in the second subset have a coat that is different than the Al—Si coat on the coated semi-finished steel products in the first subset; and a forming press disposed at an outlet region of the at least one heatable continuous furnace.

2. The apparatus of claim 1 further comprising an organic coating system for applying a coat on top of an underlying Al—Si coat of the coated semi-finished steel products in the second subset, wherein the coat applied on top of the underlying Al—Si coat gives the coated semi-finished steel products in the second subset the different coat than the coated semi-finished steel products in the first subset.

3. The apparatus of claim 1 further comprising an inorganic coating system for applying a coat on top of an underlying Al—Si coat of the coated semi-finished steel products in the second subset, wherein the coat applied on top of the underlying Al—Si coat gives the coated semi-finished steel products in the second subset the different coat than the coated semi-finished steel products in the first subset.

4. The apparatus of claim 1 wherein each of the coated semi-finished steel products in the second subset has a zinc-based coating.

5. The apparatus of claim 1 wherein the conveyer elements comprise rollers.

6. The apparatus of claim 1 further comprising a transport chain, wherein the conveyer elements comprise carriers for the coated semi-finished steel products, wherein the carriers are connected to the transport chain.

7. The apparatus of claim 1 further comprising a first furnace chamber and a second furnace chamber in the at least one decoupling portion, wherein the first conveyer element group is located in the first furnace chamber and the second conveyer element group is located in the second furnace chamber.

8. The apparatus of claim 7 wherein at least one of the first furnace chamber or the second furnace chamber is at least one of height-adjustable or laterally adjustable.

9. The apparatus of claim 1 further comprising a furnace chamber in the at least one decoupling portion, wherein the first conveyer element group is configured as a first roller conveyer in the furnace chamber and the second conveyer element group is configured as a second roller conveyer in the furnace chamber.

10. The apparatus of claim 9 wherein the furnace chamber is at least one of height-adjustable or laterally adjustable.

11. The apparatus of claim 1 further comprising at least one furnace distributing guide disposed at least one of upstream or downstream of the at least one decoupling portion.

12. The apparatus of claim 1 wherein the first conveyer element group and the second conveyer element group are height-adjustable relative to one another.

13. The apparatus of claim 1 wherein the at least one heatable continuous furnace further comprises a homogenizing portion downstream of the at least one decoupling portion.

14. An apparatus for heat treatment of coated semi-finished steel products, the apparatus comprising:

at least one heatable continuous furnace comprising at least one conveyer for moving the coated semi-finished steel products, wherein the at least one conveyer has a plurality of conveyer elements for supporting the coated semi-finished steel products, at least one decoupling portion comprising a first conveyer element group and a second conveyer element group, with each of the first and second conveyer element groups having at least one conveyer element from the plurality of conveyor elements for supporting the coated semi-finished steel products, wherein in the at least one decoupling portion the at least one conveyer element of the first conveyer element group is configured to support a first subset of the coated semi-finished steel products, wherein the coated semi-finished steel products in the first subset have an Al—Si coat, and wherein in the at least one decoupling portion the at least one conveyer element of the second conveyer element group is configured to support a second subset of the coated semi-finished steel products, wherein the coated semi-finished steel products in the second subset have a coat that is different than the Al—Si coat on the coated semi-finished steel products in the first subset, and a homogenizing portion downstream of the at least one decoupling portion.

15. The apparatus of claim 14 further comprising a transport chain, wherein the conveyer elements comprise carriers for the coated semi-finished steel products, wherein the carriers are connected to the transport chain.

16. The apparatus of claim 14 further comprising a first furnace chamber and a second furnace chamber in the at least one decoupling portion, wherein the first conveyer element group is located in the first furnace chamber and the second conveyer element group is located in the second furnace chamber.

17. The apparatus of claim 14 further comprising a furnace chamber in the at least one decoupling portion, wherein the first conveyer element group is configured as a first roller conveyer in the furnace chamber and the second conveyer element group is configured as a second roller conveyer in the furnace chamber.

18. The apparatus of claim 17 wherein the furnace chamber is at least one of height-adjustable or laterally adjustable.

19. The apparatus of claim 14 further comprising at least one furnace distributing guide disposed at least one of upstream or downstream of the at least one decoupling portion.

20. An apparatus for heat treatment of coated semi-finished steel products, the apparatus comprising:

at least one heatable continuous furnace comprising, at least one conveyer for moving the coated semi-finished steel products, wherein the at least one conveyer has a plurality of conveyer elements for supporting the coated semi-finished steel products, at least one decoupling portion comprising a first conveyer element group and a second conveyer element group, with each of the first and second conveyer element groups having at least one conveyer element from the plurality of conveyor elements for supporting the coated semi-finished steel products, wherein in the at least one decoupling portion the at least one conveyer element of the first conveyer element group is configured to support a first subset of the coated semi-finished steel products, wherein the coated semi-finished steel products in the first subset have an Al—Si coat, and wherein in the at least one decoupling portion the at least one conveyer element of the second conveyer element group is configured to support a second subset of the coated semi-finished steel products, wherein the coated semi-finished steel products in the second subset have a coat that is different than the Al—Si coat on the coated semi-finished steel products in the first subset; and a coating system for applying a coat on top of an underlying Al—Si coat of the coated semi-finished steel products in the second subset, wherein the coat applied on top of the underlying Al—Si coat gives the coated semi-finished steel products in the second subset the different coat than the coated semi-finished steel products in the first subset.

* * * * *